United States Patent [19]

Zimmerman

[11] Patent Number: 4,561,477

[45] Date of Patent: Dec. 31, 1985

[54] WOODWORKING MACHINE AND BLADES THEREFOR

[76] Inventor: Edwin H. Zimmerman, R.D. #1, New Holland, Pa. 17557

[21] Appl. No.: 574,704

[22] Filed: Jan. 27, 1984

[51] Int. Cl.[4] ..... B27C 9/04

[52] U.S. Cl. ..... 144/41; 83/837; 144/39; 144/237; 144/375; 144/374

[58] Field of Search ..... 83/837, 839, 854, 855, 83/404; 144/39, 41, 373, 374, 375, 231, 236, 237

[56] References Cited

U.S. PATENT DOCUMENTS

| | | | |
|---|---|---|---|
| 584,562 | 6/1897 | Rowlingston | 144/237 |
| 614,947 | 11/1898 | Gillette | 144/237 |
| 1,269,653 | 6/1918 | Smith | 83/837 |
| 3,229,736 | 1/1966 | Hallock . | |
| 3,380,497 | 4/1966 | La Velle . | |
| 3,977,447 | 8/1976 | Pease | 144/41 |
| 4,009,741 | 3/1977 | Zimmerman . | |
| 4,068,688 | 1/1978 | Benson | 144/237 |

FOREIGN PATENT DOCUMENTS 964557 3/1975 Canada .

*Primary Examiner*—W. D. Bray

*Attorney, Agent, or Firm*—C. Hercus Just

[57] ABSTRACT

A woodworking machine to form finished dimensional lumber from cants by a single pass of the cants through the machine and comprising compression and feed rollers above and below a longitudinal path and parallel longitudinally offset arbors respectively are mounted above and below the path upon which spaced saw blades are mounted with opposed blades in common planes and of diameters adequate to form complete cuts through a cant during a single pass, the arbors also supporting between the blades additional cutters to plane the edges of the dimensional lumber and form rounded edges thereon. The blades comprise combination saw and planer blades in which a disc has evenly spaced notches forming fingers each having a straight edge upon which tapered carbide cutting strips are mounted, the wider ends being innermost and the opposite sides of the narrower ends being rounded to permit the opposite edges of the strips to serve as planing blades capable of producing smooth faces on the lumber free of markings or ridges while the additional cutters form planed edges between the opposite faces and rounded edges at all corners of the lumber.

9 Claims, 7 Drawing Figures

Fig. 3
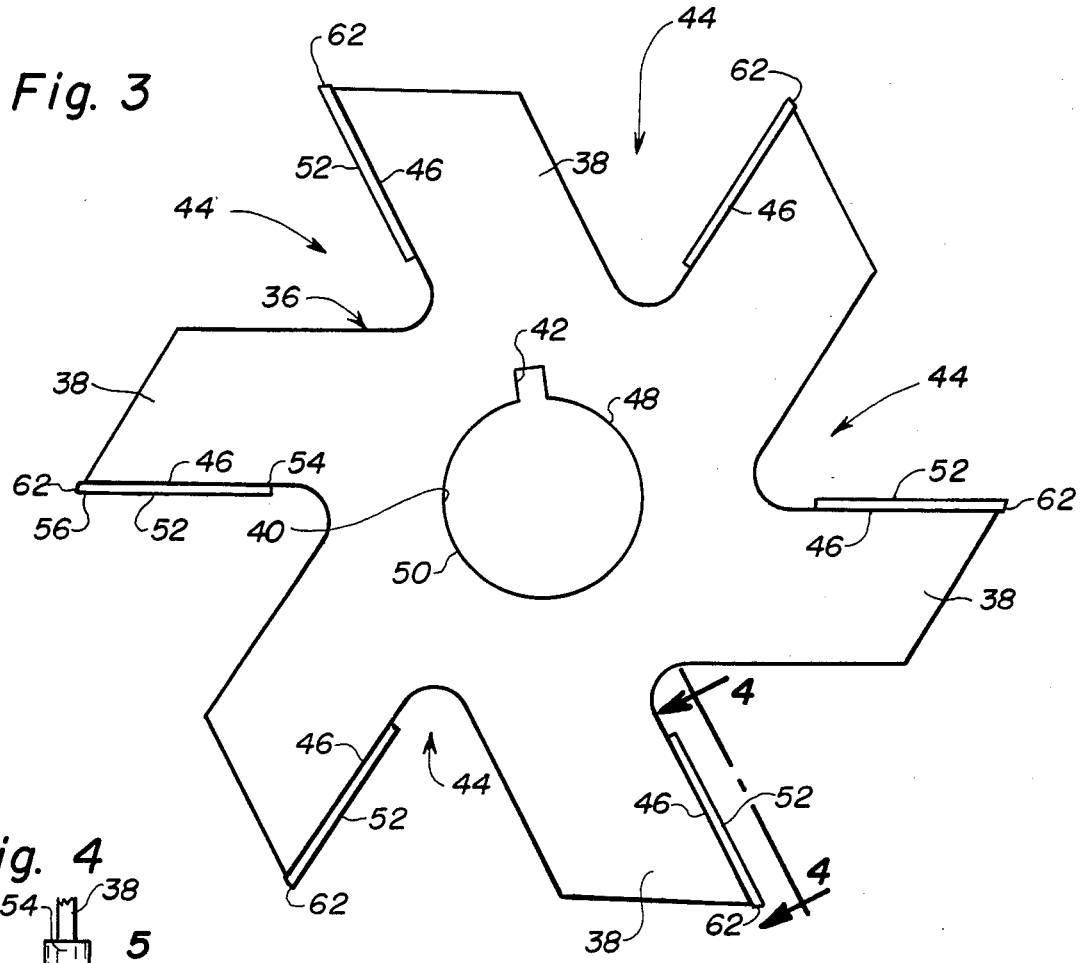
Fig. 4
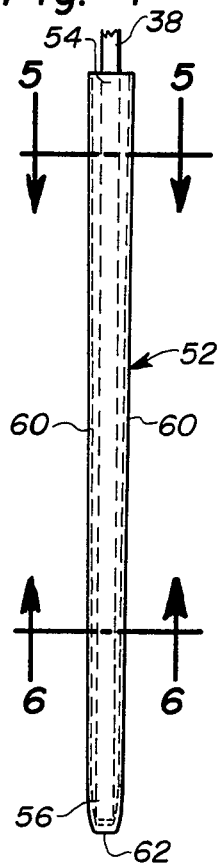
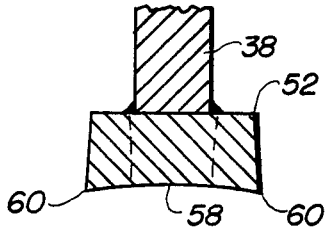
Fig. 5
Fig. 6
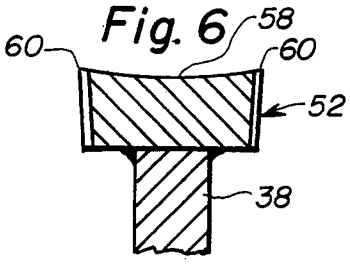
Fig. 7
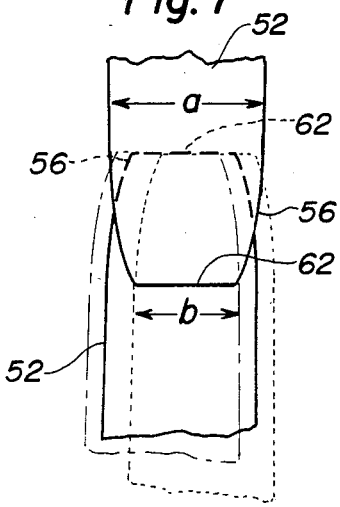

WOODWORKING MACHINE AND BLADES THEREFOR

BACKGROUND OF THE INVENTION

Essentially, the present invention comprises an improvement over or carrying forward of the invention set forth in applicant's prior U.S. Pat. No. 4,009,741, dated Mar. 1, 1977. Details of the improvements of the present invention over said prior patent are set forth hereinbelow:

The prior patent primarily comprises sets of opposed saws spaced transversely along parallel arbors respectively disposed above and below a path along which cants are moved to and beyond said sets of blades for purposes of simultaneously sawing said cants into a plurality of boards or other similar wood products and the edges of the boards also were formed selectively to provide plurality of different configurations, such as shiplap, tongue and groove, overlapping siding, and the like. Opposite surfaces or faces of the boards that were otherwise produced by by the machine actually were sawed faces and as such, contained saw marks and the like, as distinguished from planed finished surfaces.

Planed surfaces can be produced by certain types of saw blades having radially disposed planing members, either of an interrupted or continuous edge, and operable upon one or opposite faces of a saw blade. Illustrative of prior devices of this type in which the blades comprise both sawing and planing characteristics are prior U.S. Pat. No. 3,730,038 to Farb, dated May 1, 1973, U.S. Pat. No. 3,700,016 to Strobel, dated Oct. 24, 1972, and Canadian Pat. No. 964,557 to Weye, dated Mar. 18, 1975.

If blades of such prior patents are operated in pairs in the manner illustrated in applicant's prior U.S. Pat. No. 4,009,741, it has been found that particularly on the opposite faces of the product lumber either ridges or grooves usually are formed due to the inability of the planing or saw blades operating precisely in a common plane. Usually there is at least a minor offset so that a longitudinal groove or ridge is formed midway of said opposite faces of the product. As a result, it is necessary to pass such opposite faces through a planing machine. Further, in the event rounded corners are desired on the completed pieces, still further planing operations are necessary to form such rounded corners. Therefore, at present, it is common practice to form completed dimensional lumber, such as 2×4's, 2×6's, 2×8's and the like, by sawing the same from a cant and then planing the opposite faces and opposite edges as separate operations in a planing mill.

The purpose of the present invention is to eliminate the need for additional planing operations and form completely finished dimensional lumber items by a single pass through a sawing and planing machine, such as that of the present invenetion which is an improvement over applicant's aforementioned prior U.S. Pat. No. 4,009,741, details of which are set forth below:

SUMMARY OF THE INVENTION

It is common practice in the manufacture of saw blades to form the cutting teeth so that they are wider at the outer edge than at the inner edge, primarily to form clearance for the blades and prevent overheating from friction. Examples of blades of this type are shown in prior U.S. Pat. Nos. 505,154 to Bowles, dated Sept. 15, 1893, and 3,362,446 to Potomak, dated Jan. 9, 1968. The Bowles patent incidentally comprises both a saw and planer but nevertheless the outer ends of the cutting members are wider at the tips than at the portions closer to the center of the blade. Blades of this type in particular, if used in applicant's prior woodworking machine distinctly produce longidutinal ridges or grooves along the opposite faces of a lumber product. In order to prevent this however, it has been found by the applicant that if planing blades alone are used on the saw discs by attaching the same to one edge of an inwardly extending notch having at least one straight edge and have the tip of the planing blade extend at least slightly beyond the periphery of the saw disc, there is no need to utilize sharpened saw teeth in addition to the planing blades. Further, and more importantly, however, the applicant has found that by tapering carbide strips comprising the planing members of the saw and wherein the outer ends of the carbide strips are narrower than the inner ends thereof, a highly desirable planing of the opposite faces of dimensional lumber can be formed when such blades are incorporated in the machine of applicant's prior aforementioned patent. Moreover, it has further been found that if the opposite sides of the narrower outer end of the planing members of the saw blades are rendered slightly convex or rounded to a limited extent, there is no tendency for the blades to form lines or ridges in the opposite faces of dimensional lumber products, even when limited amounts of offset between cooperating blades exists.

Still further, it has been found that if the outer faces of the carbide planing strips are made at least slightly concave, the outer edges thereof comprise planing edges which are less than 90° in cross-section, and therefore facilitate the planing operation of the planing strips, together with the outer ends thereof which extend beyond the periphery of the base disc of the blade, to serve as saw teeth.

The only prior art of which applicant is aware in which a circular saw blade is narrower at the periphery than at the central portion of the disc is shown in prior U.S. Pat. No. 3,229,736 to Hallock, dated Jan. 18, 1966, the purpose of which is not clearly understood, but in any event, the narrowing of the blade adjacent the periphery is offset or nullified by the fact that the cutting teeth have a width which is even greater than the thickness of the central portion of the blade. In addition, the rounding of the outer ends of radial blades in a planing saw is illustrated in prior U.S. Pat. No. 3,380,497 to La Velle, dated Apr. 30, 1968. However, there is no longitudinal taper shown in the planer teeth, and furthermore, the length of said members is almost negligible with respect to the diameter of the overall saw blade.

The improved features of applicant's invention are set forth in detail hereinafter and in which further objectives are also set forth in addition to those enumerated hereinabove.

DESCRIPTION OF THE DRAWINGS

FIG. 3 is a side view of a combination sawing and planing blade embodying the principles of the present invention.

FIG. 4 is a fragmentary view of one of the combination sawing and planing members as seen on the line 4—4 and being illustrated on a larger scale than employed in FIG. 3.

FIG. 5 is a fragmentary, enlarged sectional view, seen on the line 5—5 of FIG. 4.

FIG. 6 is an enlarged fragmentary sectional view, as seen on the line 6—6 of FIG. 4.

FIG. 7 is a fragmentary sectional view, illustrating the relationship of opposed cutting and planing members, especially illustrating in phantom examples of misalignment of the blades such as can be tolerated but produce satisfactory results in accordance with the principles of the invention.

DETAILED DESCRIPTION OF THE PREFERRED EMBODIMENTS

Figure 1:
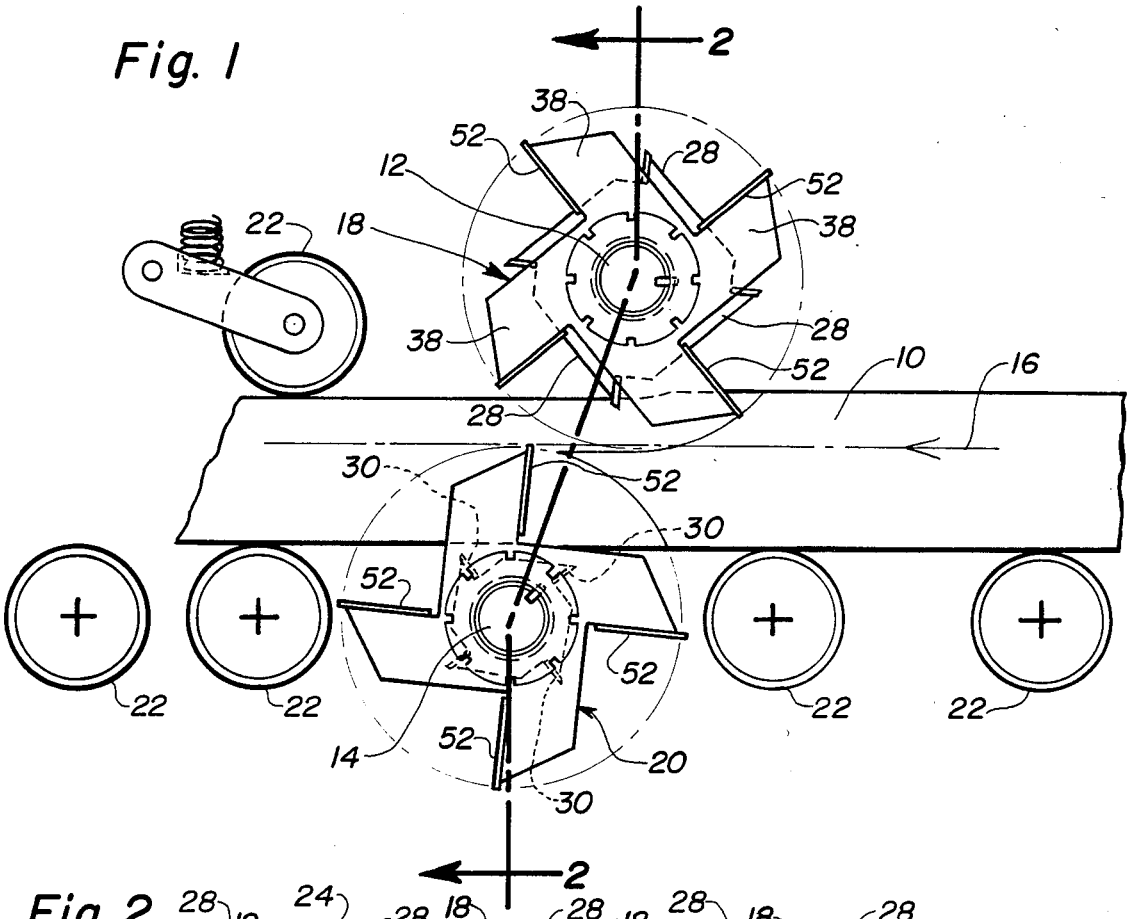
FIG. 1 is a fragmentary, somewhat diagrammatic side elevation illustrating the basic principles of the invention in which a pair of combination sawing and planing blades are positioned in operative relationship to cooperate and form a single cut or kerf in a cant of wood.

Referring to FIG. 1, there is illustrated therein, fragmentarily, and somewhat diagrammatically, those portions of a woodworking machine which are necessary to show the principles of the present invention. For a more elaborate illustration of such a machine, reference is made to applicant's prior U.S. Pat. No. 4,009,741.

In FIG. 1, there is shown a cant 10 which may be of any reasonable cross-section in size and usually rough cut at a saw mill or the like. The cant, for example, may be 10"×12", or any other conventional or appropriate size, such as commonly used for the purpose of forming finished dimensional lumber therefrom, such as those which are used for beams, studs, and the like, many different sizes of which are required in the building industry. Common sizes, for example, are 2×4's, 2×6's, 2×8's, 4×4's, etc. For example, a commercial 2×4 actually is only $1\frac{1}{2}$"×$3\frac{1}{2}$", and similar reductions in size proportionately exist in other dimensional lumber items of which examples are given above. By way of further example, and solely for illustrative purposes, by using applicant's combination saw and planing blades, a rough cut cant actually $3\frac{3}{4}$"×$8\frac{3}{4}$" can be converted into five (5) finished 2×4's of actually commercial size $1\frac{1}{2}$"×$3\frac{1}{2}$", solely as a result of one passage through the machine. In addition, and most importantly, no lines or ridges occur on either of the opposite side faces and the corners also are rounded as is normally either required or customary in commercial dimensional lumber presently marketed.

As illustrated in FIG. 1, the machine includes a pair of parallel arbors 12 and 14 which may be either of the cantilever type, as illustrated in applicant's aforementioned prior U.S. Pat. No. 4,009,741 or the arbors may be supported at opposite ends. The arbors 12 and 14 respectively are mounted above and below the path of feed for the cant 10, said path being designated by the direction arrow 16 in FIG. 1. Further with respect to a perpendicular axis to the path of feed, the arbors 12 and 14 are offset longitudinally a limited distance in order that the peripheries of the blades of the upper and lower saws 18 and 20 will not interfere with each other and it will be seen from the phantom circular path of the saws 18 and 20 that they overlap a more or less central longitudinal line parallel to the feed path, as shown in FIG. 1, whereby a kerf extending completely through the cant 10 will be formed by the cooperating saws 18 and 20. Further, the machine includes a plurality of supporting and feed rolls 22, and though not shown, additional pressure rolls engage the upper surface of cant 10 in opposition to the supporting and feed rolls 22 in the manner clearly shown in said aforementioned prior U.S. Pat. No. 4,009,741.

Figure 2:
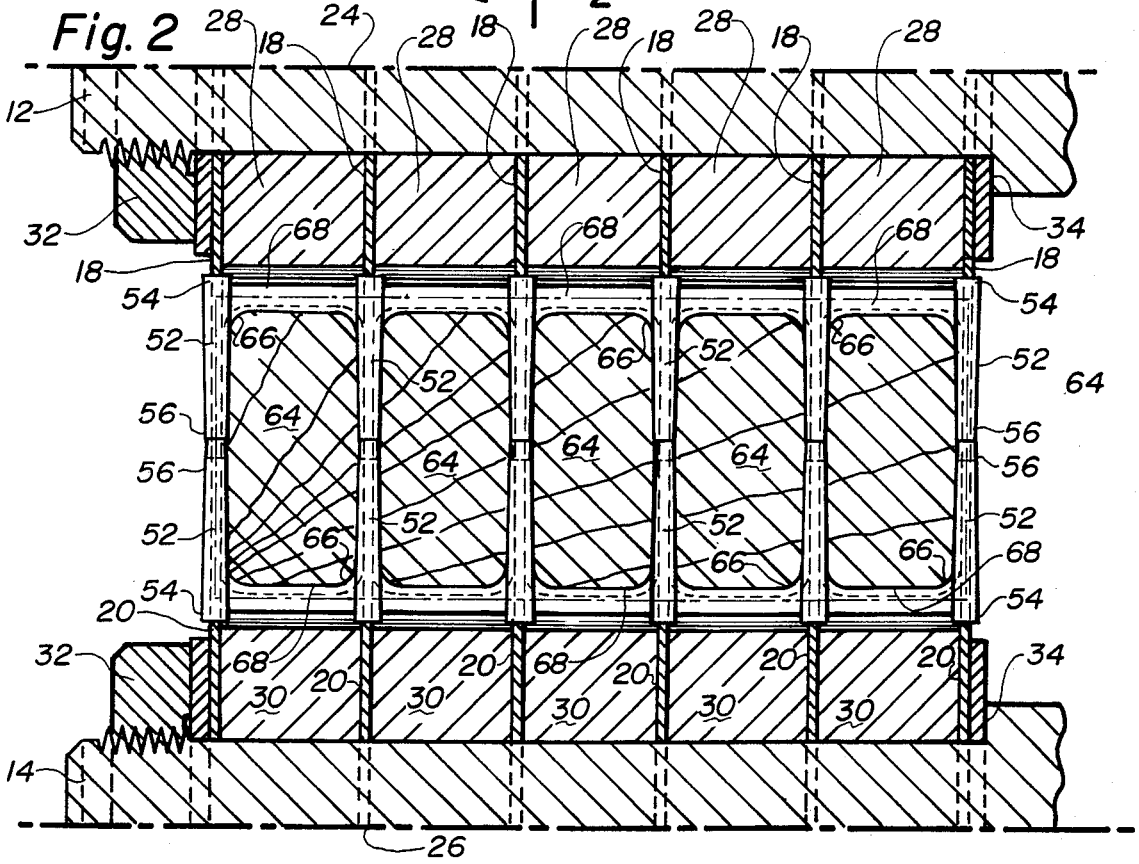
FIG. 2 is an enlarged fragmentary sectional view, showing details of the invention as illustrated along the line 2—2 of FIG. 1.

Referring to FIG. 2, which is a section view on the line 2—2 of FIG. 1, the relationship of a plurality of pairs of saws 18 and 20 are shown and it will be seen that the axes 24 and 26 respectively form the upper and lower borders of the figure. It is clearly shown that the blades 18 and 20 are commonly mounted respectively on the arbors 12 and 14 and are secured on the arbors with additional, relatively wide cutters or chipping blades 28 and 30, the entire assembly of saws and cutters or chipping blades being clamped upon the respective arbors 12 and 14 by appropriate nuts 32, which cooperate with shoulders 34 on the arbors 12 and 14, it being understood that said arbors are of the cantilever type in this particular illustration, but such arrangement is not restrictive since opposite ends of the arbors may be supported by suitable bearings, not shown, if desired. As is clear from FIG. 1, the cants 10 are supported upon a plurality of rollers 22 which underlie the same, the uppermost surfaces of the rollers defining a path of movement as symbolized by the line which includes the direction arrow 16 shown in FIG. 1.

Attention is now directed to FIG. 3 in which a saw 36 is shown which, for example, has six radial fingers 38, whereas the blades 18 and 20 in FIG. 1 only have four fingers. In accordance with the present invention, however, the saws are not restricted to any specific number of fingers and any appropriate number may be employed. The saws 18 and 20, as well as the saw 36, preferably are formed from high carbon steel of uniform thickness and provided with a central hole 40 and also preferably a keyway 42. For example, the saws may initially comprise a disc of high carbon steel and by suitable grinding or sawing, the configuration of the saws 18, 20 and 36 may be formed in any suitable manner so as to provide an equal number of similar notches 44, as shown in FIG. 3, it being understood that corresponding notches of that type are also formed in the saws 18 and 20 of FIG. 1. Preferably, one edge 46 of each notch 44 is straight and of appreciable length and said edges may either be radial with respect to the axis of arbor hole 40 or the same may be more or less tangential to side 48 of the arbor hole 40 so as to provide a positive rake, or if desired, the edges 46 may be tangential to side 50 of arbor hole 40, whereby a somewhat negative rake is afforded.

The straight edges 46 of each of the fingers 38 fixedly support carbide cutting strips 52, which preferably are of substantially uniform thickness but, as shown in FIG. 4, are slightly tapered, and the important feature is that the inner end 54 is wider than the tip end 56. The taper preferably is substantially uniform and gradual, and by way of practical example of a size that has been successfully used, where the saw 36 has a thickness of 0.1875 inches, plus or minus, depending on the diameter of the blade, and a wider inner end of the strip 52 is 0.25 inches, while the narrower tip end is 0.21 inches. These dimensions are to be considered illustrative rather than restrictive but at least the proportion of the dimensions is preferably. As seen particularly from FIG. 3, the strips 52 are nearly half the radial distance from the center of the arbor hole 40, whereas in FIG. 1, the strips are substantially half the radial distance from the tip of the strips to the axis of the arbors 12 and 14.

From FIGS. 5 and 6, it will be seen that the strips 52 are wider than the thickness of the radial fingers 38, and preferably, the strips 52 project equal amounts from opposite surfaces of the fingers 38. However, it is within the purview of the invention that, if desired, one edge of the strip 52 may be coincident with one surface of the finger 38, while the opposite edge projects a predetermined distance beyond the opposite face or surface of the fingers 38, it being understood however that alternate strips will project respectively from opposite surfaces of the fingers 38 under such circumstances. In any event, however, the strips will be tapered between the opposite ends thereof substantially in the proportions described above.

To facilitate the planing ability of the strips 52, it is seen particularly from FIGS. 5 and 6 that the outer faces 58 of the strips 52 are concave and the opposite side surfaces thereof slope inwardly in the order of 5° to 7° and are either flat or slightly concave, and thereby produce planing edges 60 on the strips, which in cross-section, are less than 90° . Also, another important feature of the present invention is that the terminal ends 62 of the tips 56 of strips 52 have the opposite sides contracted, such as by being curved, and preferably in a convex manner, inwardly toward each other to provide a cutting edge 62, which preferably is normal or perpendicular to the plane of the saw 36. Especially from FIG. 7, it will be seen that the width of the strip 52 immediately adjacent the tip end 56 has a dimension a while the terminal end 62 has a lesser dimension b. By way of further example, the dimension b is substantially of the order between one-half and three-fourths of that of dimension a.

The purpose of having the outer end 56 of the strip curve inwardly to form the cutting end 62 is that when the saws are operating, it is not possible for the actual corners, for example, of the cutting ends 62 to finally engage the opposite faces of the finished dimensional lumber item 64, and therefore no line or ridge is formed upon such surfaces as usually is the case where the terminal ends of planing blades or saws have no relieved areas and instead have parallel opposite surfaces at the terminal ends.

To illustrate the advantage of the foregoing arrangement, attention is directed to FIG. 7 in which it will be seen that the terminal end of the strip 52 on one blade is shown in full lines relative to the terminal end 52 on a cooperating blade which is not only illustrated in preferred form in full lines, but in addition, several phantom line illustrations of the second tip end are shown, and in all of these it will be seen that the other edges of the cutting edges are narrower or closer together than the remaining portions of the strips 52, so that even though there is a limited amount of misalignment of the cooperating saws on the arbors, there is still no reasonable possibility of forming objectionable markings of any kind, including grooves, lines, or ridges which usually are found on the opposite faces of dimensional lumber when conventional planing blades are used in conjunction with each other.

It also will be noted from both FIGS. 1 and 3 that the tip ends 62, which actually function in sawing capacities, project at least a short distance beyond the outermost ends of the fingers 38 to facilite their functioning in sawing capacity.

Further for purposes of producing dimensional lumber which is finished in all respects by means of a single passage through the machine comprising the present invention, attention is directed to FIG. 2 in which cross-sectional views of completely finished dimensional lumber items 64 are shown which have rounded corners 66. These are formed by means of the relatively wide cutters or chipping blades 28 and 30, which have terminal, preferable carbide, chipping blades 68 formed thereon in which the ends have concave configurations for purposes of planing the corners of the conventional lumber items to form the desired rounded edges thereon as now is quite common in the commercial production of dimensional lumber items, such as 2×4's, 2×6's, etc.

From the foregoing, therefore, it will be seen that the present invention is capable of producing, by means of one passage of a cant through the machine, a plurality of similar completely finished conventional lumber items, which meet all of the current specifications for such items otherwise made by planing all four surfaces as independent operations and frequently required to be done on different machines, whereas by using the present invention, a single machine is capable of producing completely finished dimensional lumber items, meeting all the requirements and specifications currently observed by present producers of lumber, and particularly conserving power due to the process requiring only a single passage through the machine. By way of specific example as shown in FIG. 2, assume that the original cant was rough sawed and is $3\frac{3}{4}''$ thick by $8\frac{3}{4}''$ wide, a total of five (5) completely finished 2×4's are produced simultaneously as a result of having said cant make a single pass through the machine. By using cooperating blades of suitable diameter, finished dimensional lumber items as small, for example, as 2×2's and on up to 2×12's or more may be produced in the machine illustrated and claimed herein and conceivably even conventional lumber of larger sizes are capable of being produced, depending upon the diameters of the saws, chipping blades and the like.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A combination saw and planer blade for use in producing finished dimensional lumber comprising in combination, a steel of uniform thickness which is notched substantially radially at circumferentially spaced locations to produce substantially radial straight edges extending from the periphery of the disc inwardly to uniform depths, and carbide cutting strips of greater width than the thickness of said disc affixed to said straight edges and extending therealong from the tip ends of said edges inwardly toward the base of each notch, said strips being tapered longitudinally and the outer ends being narrower than the inner ends and extending at least a short distance beyond the outer end of said straight edges, the opposite sides of said strips also respectively being tapered inwardly from the leading faces in the direction of rotation of the saw, whereby the sides of said strips comprise planing blades and the opposite sides of the outer terminal ends of said strips define means curved toward each other so as to provide a relief operable to prevent the formation of ridges or lines or the like on the faces of finished items of dimensional lumber when a pair of said saws operated respectively upon the top and bottom surfaces of a cant to produce finished planed pieces of lumber.

2. The combination blade according to claim 1 in which the outer face of said strips is concave, thereby providing sharp cutting edges at opposite side which are less than 90° in cross-section.

3. A woodworking machine for forming dimensional lumber from cants of larger size and shaping the edges of said lumber comprising in combination:

a. said machine having a longitudinal path of travel for said cants, b. a pair of parallel horizontal arbors extending transversely to said path and respectively spaced above and below said path and longitudinally offset from each other, c. supporting and tensioning rollers positioned respectively above and below said path for movement of cants unidirectionally therealong, d. a plurality of pairs of similar circular combination saw and planer blades each comprising a steel disc of uniform thickness notched substantially radially at circumferentially spaced locations to produce substantially radial fingers each having similar straight edges extending inward from the periphery of said disc, e. a carbide cutting strip of greater width than the thickness of said disc respectively affixed to each straight edge of said fingers and at least one edge of each strip projecting beyond a surface of said disc and sharpened to serve as a radial planing edge, f. said strips being simlarly gradually tapered with the thicker ends being innermost and the thinner end projecting at least slightly beyond the outer ends of said straight edges of said fingers and being sharp to comprise saw teeth, g. a plurality of said blades being mounted upon said arbors in similarly spaced relationship with spacing elements therebetween and the blades on one arbor respectively being in the same plane as corresponding blades on the other arbor, the radius of said blades being at least slightly greater than the vertical distances between said arbors and said path of travel, whereby the blades in one plane when rotating in cooperation make a complete cut in a cant between opposite surfaces without interference in view of the longitudinal offset of said arbors, and h. the opposite sides of the outer terminal ends of said strips being at least slightly curved convexly toward each other to define means forming smooth opposite surfaces on the dimensional lumber pieces formed by said machine as a result of a single pass of a cant therethrough.

4. The machine according to claim 3 further characterized by said strips extending transversely across the straight edges of said fingers in said disc and projecting substantially equally from opposite surfaces of said disc, whereby the opposite edges of said strips respectively and simultaneously plane the faces of adjacent lumber pieces for the full width of said faces.

5. The machine according to claim 4 in which said spacing elements on said arbors between said blades are of less diameter than said blades and comprising chipping blades having central cutting edge portions parallel to said arbors and the opposite ends of said cutting edge portions having sharp concave projections respectively adapted to form the edge surfaces of the dimensional lumber pieces and provide the same with rounded edges, whereby a single passage of a cant through said machine produces completely finished dimensional lumber having no lines or ridges on the opposite faces thereof and the edges are all rounded.

6. The machine according to claim 3 in which the outer faces of said strips are concave and thereby provide opposite sharp planing edges at opposite sides which are less than 90° in cross-section.

7. The machine according to claim 3 in which the terminal ends of said strips between said opposite curved sides thereof are straight and normal to the plane of said disc and comprise sharp saw teeth.

8. The machine according to claim 3 in which the opposite said faces of said strips slope inwardly from the outermost edges thereof a limited amount toward each other at angles not in excess of 10° relative to the plane of said blades, thereby to provide clearance with the work being planed by said strips and increase the planing ability of said strips.

9. The machine according to claim 8 further characterized by the outer faces of said strips being concave, thereby further to render the cutting edges of said strips sharp and facilitate the planing ability of the strips by providing opposite sharp planing edges on said strips which are less than 90° in cross-section.

* * * * *